US008794598B2

(12) United States Patent
Carbines

(10) Patent No.: US 8,794,598 B2
(45) Date of Patent: Aug. 5, 2014

(54) FENCE

(75) Inventor: Richard James Carbines, Auckland (NZ)

(73) Assignee: Jenkin Timber Limited, Auckland (NZ)

( * ) Notice: Subject to any disclaimer, the term of this patent is extended or adjusted under 35 U.S.C. 154(b) by 114 days.

(21) Appl. No.: 13/141,537

(22) PCT Filed: Dec. 23, 2009

(86) PCT No.: PCT/NZ2009/000304
§ 371 (c)(1),
(2), (4) Date: Sep. 9, 2011

(87) PCT Pub. No.: WO2010/082848
PCT Pub. Date: Jul. 22, 2010

(65) Prior Publication Data

US 2011/0315941 A1 Dec. 29, 2011

(30) Foreign Application Priority Data

Dec. 24, 2008 (NZ) ..... 574021

(51) Int. Cl.
*E04H 17/14* (2006.01)

(52) U.S. Cl.
USPC ..... 256/19; 256/21; 256/24

(58) Field of Classification Search
USPC ..... 256/19, 21, 24, 25
See application file for complete search history.

(56) References Cited

U.S. PATENT DOCUMENTS

| | | | | |
|---|---|---|---|---|
| 2,397,458 | A * | 4/1946 | Allen | 52/473 |
| 3,503,589 | A | 3/1970 | Moore | |
| 3,698,692 | A | 10/1972 | Burrows, Jr. | |
| 3,963,219 | A * | 6/1976 | D'Amico | 256/24 |
| 4,007,919 | A | 2/1977 | Totten | |
| 4,149,700 | A * | 4/1979 | Stafford | 256/24 |
| 5,078,367 | A * | 1/1992 | Simpson et al. | 256/24 |
| 5,272,284 | A | 12/1993 | Schmanski | |
| 5,639,069 | A | 6/1997 | McClure | |
| 5,702,090 | A | 12/1997 | Edgman | |
| 6,217,007 | B1 | 4/2001 | Grayson, II et al. | |
| 7,419,141 | B2 | 9/2008 | Wall | |
| 2004/0074189 | A1 | 4/2004 | Deschenes | |
| 2007/0245972 | A1 | 10/2007 | Symons | |

FOREIGN PATENT DOCUMENTS

| | | |
|---|---|---|
| GB | 2 088 922 A | 6/1982 |
| GB | 2 161 841 A | 1/1986 |
| GB | 2 374 880 A | 10/2002 |
| GB | 2 420 795 A | 6/2006 |
| WO | WO 02/064910 A | 8/2002 |

* cited by examiner

*Primary Examiner* — Michael P Ferguson

(74) *Attorney, Agent, or Firm* — Frommer Lawrence & Haug LLP; Ronald R. Santucci

(57) ABSTRACT

A fence (10) comprising at least two spaced-apart substantially upright fence posts (12*a*, 12*b*) anchored into the ground or other fixed structure and a stack of at least two boards (14) extending between each pair of adjacent fence posts. Each board (14) extends in a substantially horizontal orientation relative to the upright fence posts and is supported at each end by a respective fence post (12*a*,12*b*). At least one pair of retaining components (16*a*,16*b*) are provided on each fence post (12*a*,12*b*) and each pair of retaining components forms a series of cavities that are each shaped to receive and retain a respective end of a board (14) of the stack to thereby support the respective end of the board (14) at the fence post (12*a*, 12*b*).

22 Claims, 7 Drawing Sheets

FENCE

This application is a 371 of PCT/NZ2009/000304 filed on Dec. 23, 2009, published on Jul. 22, 2010 under publication number WO 2010/082848 A and claims priority benefits of New Zealand Patent Application No. 574021 filed Dec. 24, 2008, the disclosure of which is incorporated herein by reference.

FIELD OF THE INVENTION

The present invention relates to fencing. In particular, although not exclusively, the invention relates to a fence system for constructing permanent or temporary fencing.

BACKGROUND TO THE INVENTION

Various types of fence constructions are known. Typically, fence constructions comprise a framing onto which a series of vertically or horizontally oriented fence boards, such as palings, are attached. The framing often comprises a series of spaced apart upright fence posts that are anchored into the ground by concrete foundations and are joined to each other by one or more cross-members, which are often referred to as 'rails'. The fence boards are commonly nailed or screwed to the fence posts and cross-members of the framing in an aligned manner.

The effort required to construct a fence of the type above depends on the overall height and length of the fence. A fence installer or builder must first prepare the framing and install the fence posts with supporting concrete foundations, and also fix the cross-members in place. The installation of the fence boards on the framing can be time consuming as each board requires alignment and fixing via nails or screws into the framing.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

It is an object of the present invention to provide an improved fence, or to at least provide the public with a useful choice.

SUMMARY OF THE INVENTION

In a first aspect, the present invention broadly consists in a fence comprising: at least two spaced-apart substantially upright fence posts anchored into the ground or other fixed structure; a stack of at least two boards extending between each pair of adjacent fence posts, each board extending in a substantially horizontal orientation relative to the upright fence posts and being supported at each end by a respective fence post, and each board being engaged in an overlapping relationship with adjacent upper and lower boards of the stack via a tongue and groove interlocking arrangement; and at least one pair of retaining components provided on each fence post, each pair of retaining components being arranged to form a series of cavities, each cavity being shaped to receive and retain a respective end of a board of the stack to thereby support the respective end of the board at the fence post.

In one form, each board has a top surface and base surface, and a tongue is provided along the top surface and a groove is provided along the base surface for engaging in an interlocking arrangement with other like adjacent boards in the stack.

Preferably, each board has a cross-sectional profile defined by a base surface and a top surface between which two opposed side surfaces extend, and wherein each board is provided with a groove along the base surface and the top surface of the board is arranged as a tongue that is shaped to engage with the groove of an upper board of the stack in an interlocking arrangement. More preferably, the groove of each board is centrally located in the base surface relative to the side surfaces of the board.

By way of example, each board may have a cross-sectional profile that is substantially triangular in which the two side surfaces extend from the base surface and taper toward each other to form an apex portion at the top surface of the board. Preferably, the groove of each board is centrally located in the base surface relative to the side surfaces and the apex portion of the top surface forms the tongue for engaging into the groove of an adjacent upper board of the stack in an interlocking arrangement.

In another form, each board has a top surface and a base surface, and a tongue is provided along the base surface and a groove is provided along the top surface for engaging in an interlocking arrangement with other like adjacent boards in the stack.

Preferably, each board has a top surface and a base surface, and the cross-sectional profile of each board is symmetrical about a central line extending from the top surface to the base surface.

Preferably, each pair of retaining components comprises retaining components having an opposing profile to the other retaining component of the pair and are arranged to be fixed on the fence post so as to form the series of cavities on the fence post into which the respective ends of each board of the stack are received and retained at the fence post.

Preferably, each pair of retaining components is arranged to sandwich respective ends of the stack of boards such that each retaining component of each pair engages with opposite side surfaces of the boards of the stack.

Preferably, each retaining component has a series of formations, each formation being arranged or shaped to engage or abut with at least a portion of the respective base and side surfaces of a respective board of the stack. More preferably, each formation in the series of formations of each retaining component is provided with a seat surface that is arranged to support a respective side of the base surface of a board of the stack and a clamping portion that is arranged to abut with a respective side surface of the same board of the stack.

The fence may, in some forms, further comprise a lower cross-member(s) fixed to extend beneath the stack of boards between the or each pair of adjacent upright fence posts. Additionally or alternatively, the fence may, in some forms, further comprise an upper cross-member(s) that is fixed to extend above the stack of boards in between or upon each pair of adjacent upright fence posts.

In a second aspect, the present invention broadly consists in a modular fence system comprising one or more adjacent fence blocks that collectively form a fence, each fence block comprising: two spaced apart pairs of substantially upright retaining components; a stack of at least two boards extending between the two pairs of retaining components, each board extending in a substantially horizontal orientation relative to the upright retaining components and being supported at each end by a respective pair of retaining components, and each board being engaged in an overlapping relationship with adjacent upper and lower boards of the stack via a tongue and groove interlocking arrangement; and wherein each pair of retaining components is arranged to form a series of cavities, each cavity being shaped to receive and retain a respective end of a board of the stack to thereby support the respective end of the board.

The modular fence system of the second aspect may comprise any one or more of the features mentioned in respect of the first aspect of the invention.

In a third aspect, the present invention broadly consists in a fence system comprising: at least two fence posts that are arranged to be installed in a substantially upright orientation and spaced-apart manner into the ground or other fixed structure; a plurality of boards that are arranged to be stacked between each pair of adjacent fence posts with each board extending in a substantially horizontal orientation relative to the upright fence posts and being supported at each end by a respective fence post, and each board being engaged in an overlapping relationship with adjacent upper and lower boards of the stack via a tongue and groove interlocking arrangement; and at least one pair of retaining components that are arranged to be fixed to each fence post with each pair of retaining components being arranged to form a series of cavities, each cavity being shaped to receive and retain a respective end of a board of the stack to thereby support the respective end of the board at the fence post.

The fence system of the third aspect may comprise any one or more of the features mentioned in respect of the first aspect of the invention.

In a fourth aspect, the present invention broadly consists in a method of constructing a fence with the fence system of the third aspect of the invention, comprising the steps of: (a) fixing at least two spaced-apart fence posts into the ground or surface such that they extend in a substantially upright orientation; (b) fixing at least one of the retaining components of each pair of retaining components to one side of a surface of each fence post to provide a series of open cavities that are shaped to receive and support a respective end of a board; (c) stacking the boards upon each other between each pair of adjacent fence posts to a desired height such that each board is supported at its ends by respective open cavities of the fixed retaining components; and (d) fixing the opposing retaining component of each pair to the opposite side of the respective surfaces of the fence posts to close the series of cavities and thereby secure the stack of boards in place between each adjacent pair of fence posts.

In one form, the method further comprises the step of fixing a lower cross-member between each pair of adjacent fence posts at or toward the bottom end of the fence posts before step (a).

In another form, the method further comprises the step of fixing an upper cross-member between or upon each pair of adjacent fence posts at or toward the top end of the fence posts after step (d).

In a fifth aspect, the present invention broadly consists in a fence comprising: at least two spaced-apart substantially upright fence posts anchored into the ground or other fixed structure; a stack of at least two boards extending between each pair of adjacent fence posts, each board extending in a substantially horizontal orientation relative to the upright fence posts and being supported at each end by a respective fence post, and each board being engaged in an overlapping relationship with adjacent upper and lower boards of the stack via a tongue and groove interlocking arrangement; and at least one retaining formation provided on each fence post, each retaining formation providing a series of cavities, each cavity being shaped to receive and retain a respective end of a board of the stack to thereby support the respective end of the board at the fence post.

In one form, the retaining formations are integrally formed into the opposing surfaces of adjacent fence posts. In another form, each retaining formation is provided by a pair of retaining components fixed to an upright side surface of the fence post, each pair of retaining components being shaped to cooperate with each other to form the series of cavities.

The fence of the fifth aspect may have any one or more of the features mentioned in respect of the first aspect of the invention.

Also described is a fence, comprising: at least two spaced-apart substantially upright fence posts anchored into the ground or other fixed structure; a stack of at least two boards extending between each pair of adjacent fence posts, each board extending in a substantially horizontal orientation relative to the upright fence posts and being supported at each end by a respective fence post, and each board being arranged to engage in an overlapping relationship with any adjacent upper and lower boards of the stack via a tongue and groove interlocking arrangement; and at least one retaining formation provided on each fence post, each retaining formation providing a series of cavities, each cavity being shaped to receive and retain a respective end of a board of the stack to thereby support the respective end of the board at the fence post.

Also described is a fence comprising: at least two spaced-apart substantially upright fence posts anchored into the ground or other fixed structure; a stack of at least two boards extending between each pair of adjacent fence posts, each board extending in a substantially horizontal orientation relative to the upright fence posts and being supported at each end by a respective fence post, and each board being arranged to engage in an overlapping relationship with any adjacent upper and lower boards of the stack via a tongue and groove interlocking arrangement; and at least one pair of retaining components provided on each fence post, each pair of retaining components being arranged to form a series of cavities, each cavity being shaped to receive and retain a respective end of a board of the stack to thereby support the respective end of the board at the fence post.

The term "board" as used in this specification and claims, unless the context suggests otherwise, is intended to cover any suitable type, shape, or profile of elongate fencing board, having a desired length, and including, by way of example only, palings and weatherboards or similar cladding.

The term "comprising" as used in this specification and claims means "consisting at least in part of". When, interpreting each statement in this specification and claims that includes the term "comprising", features other than that or those prefaced by the term may also be present. Related terms such as "comprise" and "comprise" are to be interpreted in the same manner.

As used herein the term "and/or" means "and" or "or", or both.

As used herein "(s)" following a noun means the plural and/or singular forms of the noun.

The invention consists in the foregoing and also envisages constructions of which the following gives examples only.

BRIEF DESCRIPTION OF THE DRAWINGS

Preferred forms of the invention will be described by way of example only and with reference to the drawings, in which.

DETAILED DESCRIPTION OF PREFERRED FORMS

The invention relates to a fence system that has a modular construction. The modular fence can be used for installing temporary or permanent fencing or barriers to suit varying lengths and heights, as desired.

By way of example, a preferred form fence system 10 will be described with reference to FIGS. 1-5D. The fence system 10 comprises a framing upon which a number of fence boards 14 are supported. The fence is preferably modular in that it may comprise a number of fence blocks that are linked or concatenated together to form an overall fence boundary. For clarity, the construction of a single fence block of the fence will be described.

In the preferred form, the framing comprises at least two spaced-apart fence posts 12*a*,12*b* that have a substantially vertical or upright orientation relative to the ground or surface upon which the fence is constructed. By way of example, the fence posts 12*a*, 12*b* may have a square, rectangular or any other suitable cross-sectioned profile. Between the pair of left 12*a* and right 12*b* fence posts is a number of vertically stacked and substantially horizontally oriented fence boards 14. The length of the boards 14 is preferably substantially equal to the free distance between the facing sides of the fence posts 12*a*,12*b*. In the preferred form, the boards 14 are in the form of wooden weatherboards. However, it will be appreciated that any other fence boards formed from other materials could alternatively be used. For example, board and other fencing components could alternatively be any PVC composite material, steel, or any other type of wood.

Figure 1A:
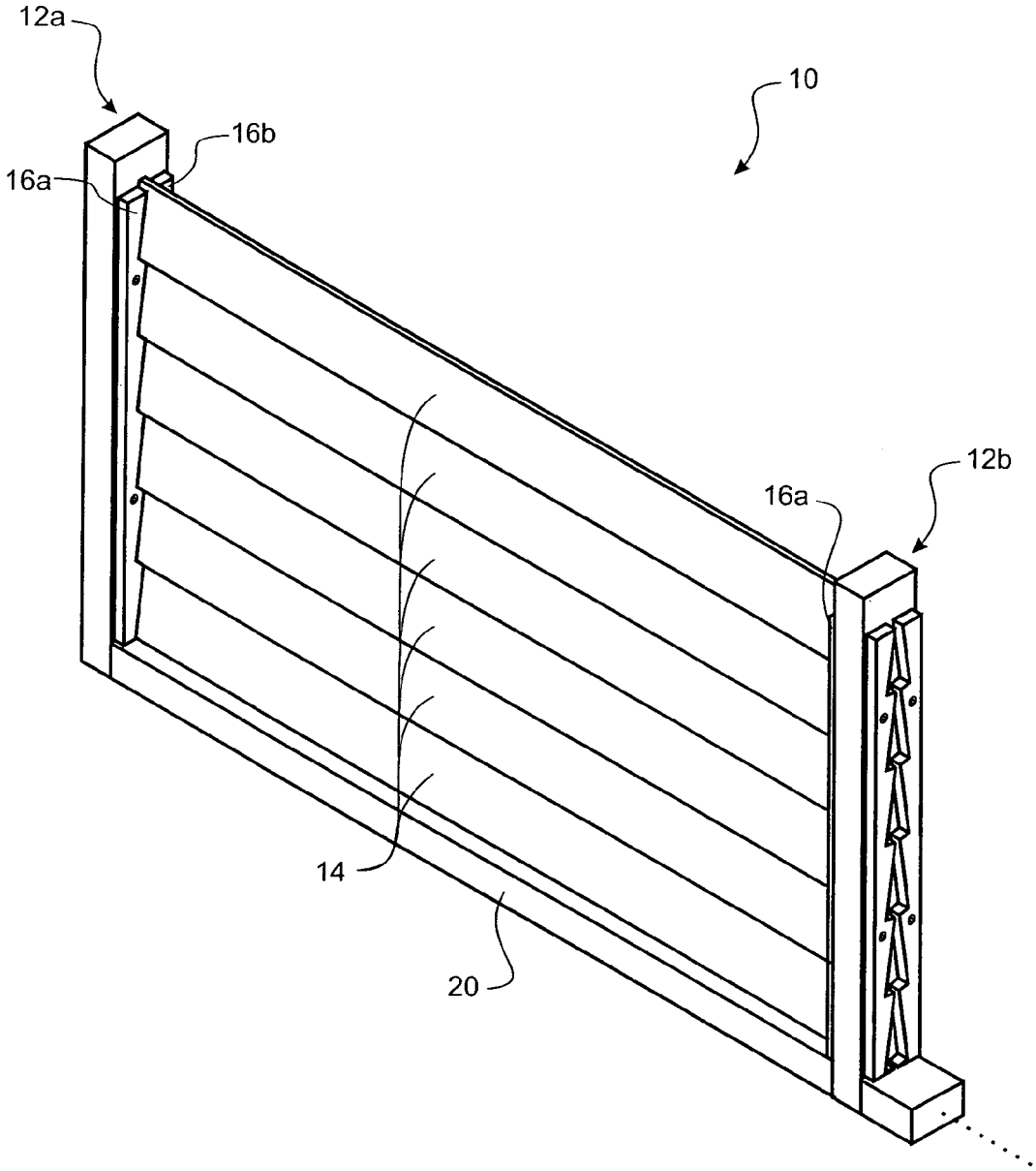
FIG. 1A is a perspective view of a preferred form fence block of the invention.
Figure 1B:
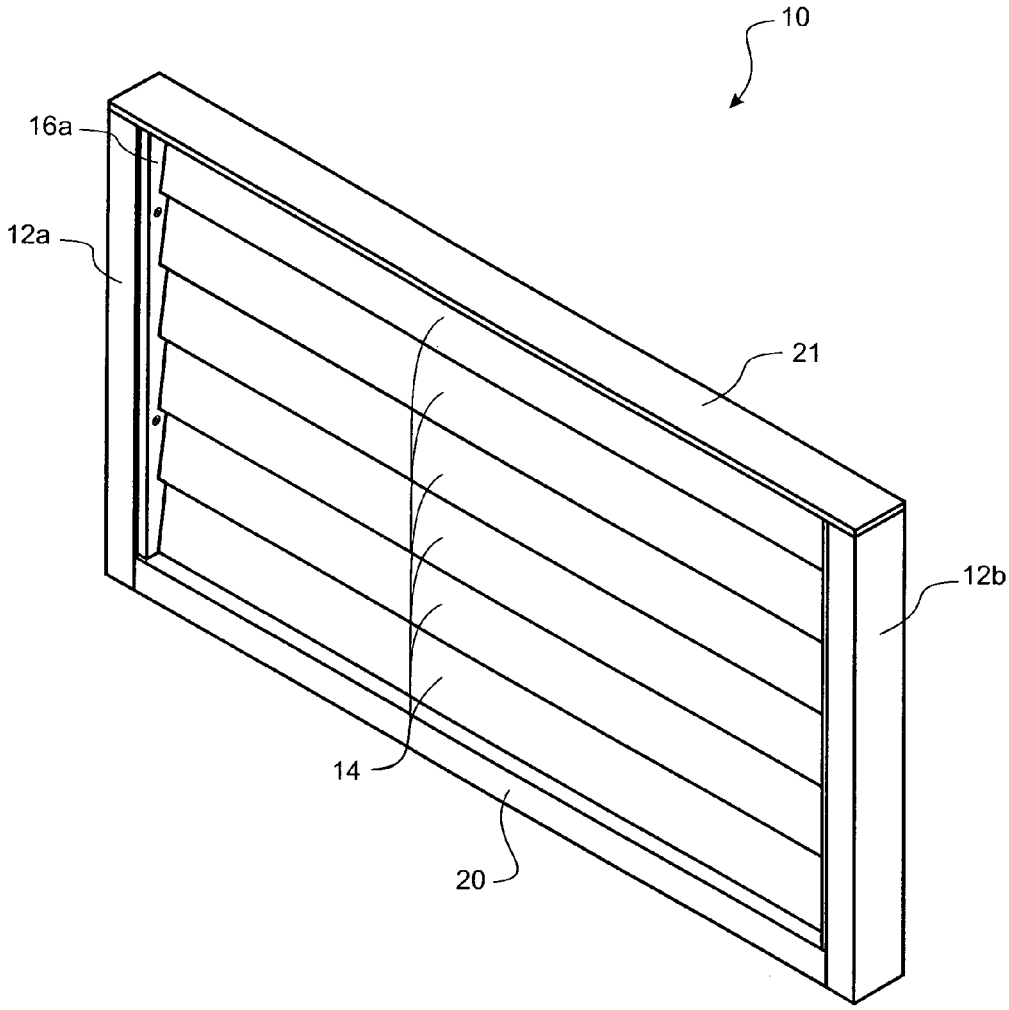
FIG. 1B is a perspective view of a the fence block of the type shown in FIG. 1A and additionally showing an upper cross-member above the stack of boards.

In the preferred form, the framing of the fence 10 is also provided with a lower cross-member 20 that is fixed between the lower ends of the fence posts 12*a*,12*b* underneath the stack of boards 14. If desired, an upper cross-member 21 or other upper capping member may be fixed between or upon the fence posts above the stack of boards 14 as shown in FIG. 1B. The fence posts 12*a*,12*b* may be anchored into the ground or surface below the fence via any known means, including concrete or other anchoring materials, or may be driven into the ground as is known in fence construction.

The facing or opposing upright side surfaces of the or each pair of adjacent fence posts 12*a*,12*b* are provided with a pair of retaining components, which may be in the form of wooden scribes 16*a*, 16*b*. Each pair of scribes 16*a*,16*b* oppose each other and form a series of retaining cavities or recesses between each other. Each cavity is shaped to receive and retain an end of a respective board 14 of the stack to thereby support the board on the fence post 12*a*,12*b*. In effect, the pair of scribes 16*a*,16*b* on each fence post 12*a*,12*b* have a shape that conforms or corresponds to the overall peripheral profile of the stack of boards 14 and they act to sandwich or clamp the respective ends of the boards of the stack in place between the scribes on the fence posts 12*a*,12*b*.

Figure 2:
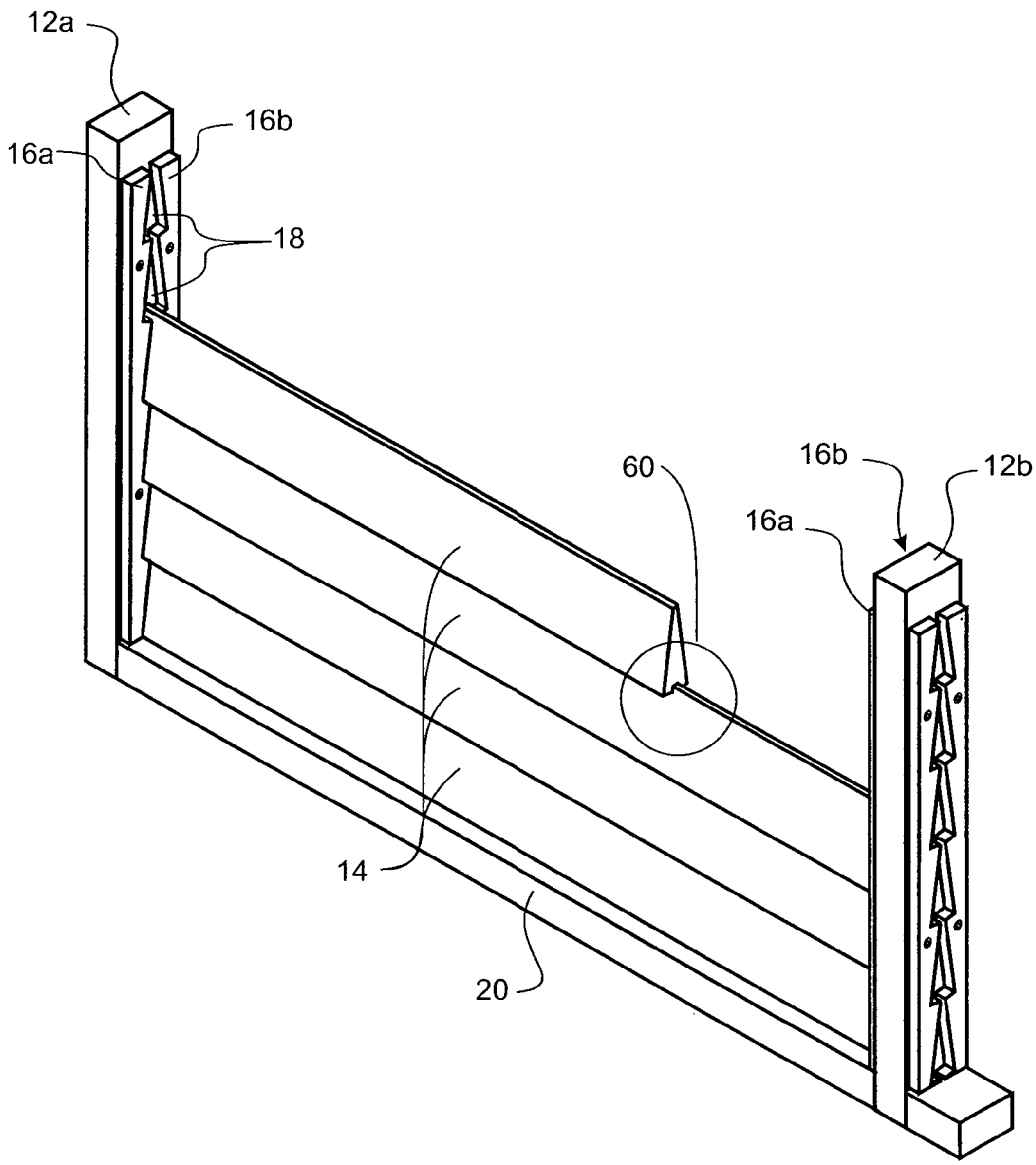
FIG. 2 shows a partially installed fence block of FIG. 1A and a cut away of the top board showing the overlapping relationship with the lower adjacent board.

The retaining cavities 18 provided between the scribes 16*a*,16*b* can be seen in FIG. 2. The structural integrity of the stack of boards is also preferably enhanced by an overlapping relationship between the stack of boards 14, although this arrangement is not necessarily essential. For example, in the preferred form fence the top surface of each board is arranged to engage into a groove provided on the base surface of the adjacent upper board in the stack so as to form an overlapping and interlocking relationship between adjacent boards in the stack. This will be explained in more detail later.

It will be appreciated that the height of the fence may be altered as desired by either increasing the number of boards in the stack, the height of each board, or both. Likewise, the width of the fence or each fence block may be altered as desired by adjusting the distance between the fence posts and additionally the length of each board that extends between the fence posts of each fence block.

An overall fence construction may include a single or multiple concatenated or linked fence blocks. In a multi-block construction, the framing includes multiple pairs of adjacent fence posts that may be provided to conform to the boundary of the fence and overall fence profile, whether that is a straight fence, curved or a partially open or fully enclosed fence. Between each pair of fence posts will be a stack of boards. By way of example, FIG. 1A shows that the right fence post 12*b* may support a first stack of boards 14 on one side in co-operation with the left fence post 12*a*, and a second stack of boards on the other side in co-operation with another spaced-apart fence post (not shown).

Depending on the overall fence construction and profile, each fence post may be arranged to support one or more stacks of boards. As shown in FIG. 1A, the right fence post 12*b* is arranged to support two stacks of boards, one on either side. However, it will be appreciated that more than two stacks could alternatively be supported if the fence post has enough vertical surfaces to support more pairs of scribes. For example, with a fence post having a substantially square or rectangular cross-sectional profile, four pairs of scribes for supporting four stacks of boards could be supported on all four flat vertical surfaces of the fence post, if desired.

Figure 3:
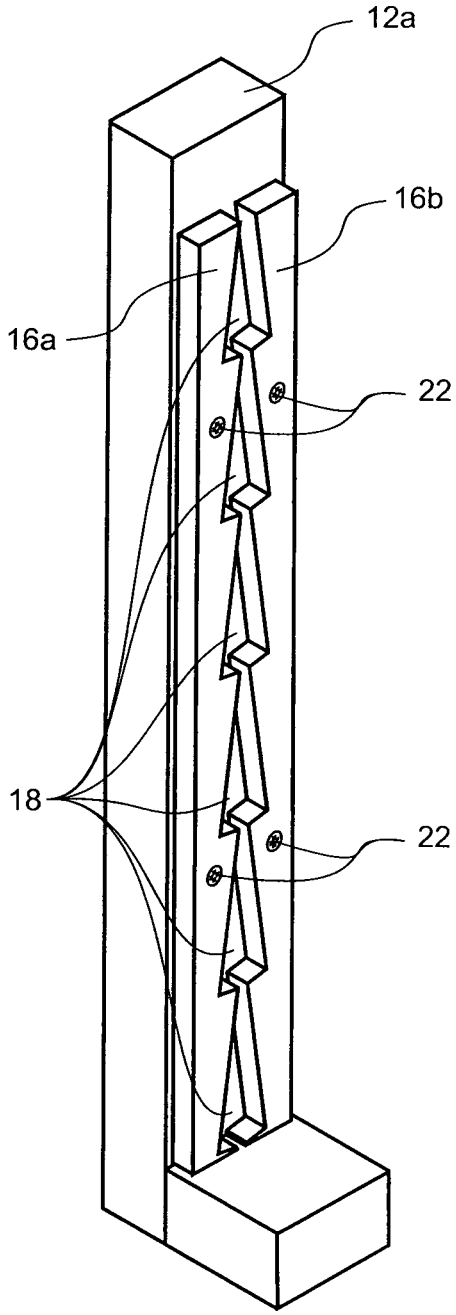
FIG. 3 shows a perspective view of a fence post of the preferred form fence provided with a pair of retaining components.

Referring to FIG. 3, the scribes may be fixed to the fence post 12 via fixing components 22 such as screws or nails that extend through the scribe and into the fence post underneath. Alternatively, the scribes may be attached via an adhesive or any other fixing means.

Figure 4:
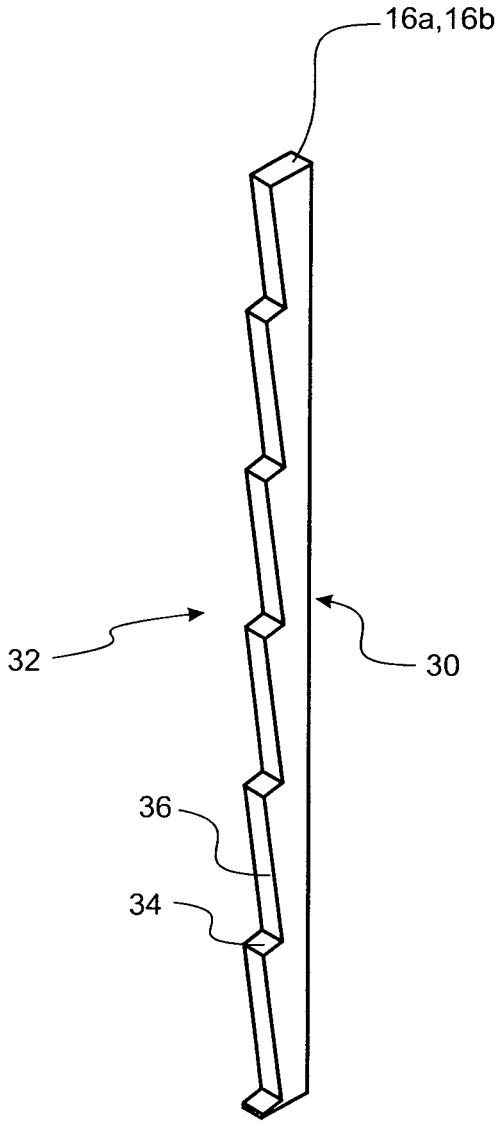
FIG. 4 shows a perspective view of a single retaining component of the preferred form fence.

Referring to FIG. 4, a scribe component 16*a*,16*b* is shown. The scribe component may be formed from any material, for example wood, metal or plastic. In the preferred form, the scribe is wooden. The scribe preferably has a straight outer surface 30 and a stepped inner surface 32. The stepped inner surface 32 comprises a series of outwardly extending seat portions or surfaces 34. Extending between the base of each seat portion and the outer edge of an upper adjacent sear portion 34 is an outwardly extending or angled clamping surface 36. In the preferred form, the seat portions 34 have a slightly declined orientation relative to the horizontal but it will be appreciated that a substantially horizontal or slightly inclined orientation relative to the horizontal may alternatively be used depending on the profile of boards being supported. As will be described with references to FIGS. 5A-5D, the preferred form fence boards have a substantially triangular cross-sectional profile and the inner surface 32 of the scribes are shaped to conform to the overall exterior profile of the stack of boards. In particular, the seat portions 34 of the scribes are intended to support one side of the base surface of each board and the clamping surfaces 36 are arranged to engage with a portion of a side surface of the boards 14. Each pair of seat 34 and clamping 36 surfaces collectively provide a retaining formation that is arranged to abut or engage with a respective board 14 of the vertical stack.

Figure 5A:
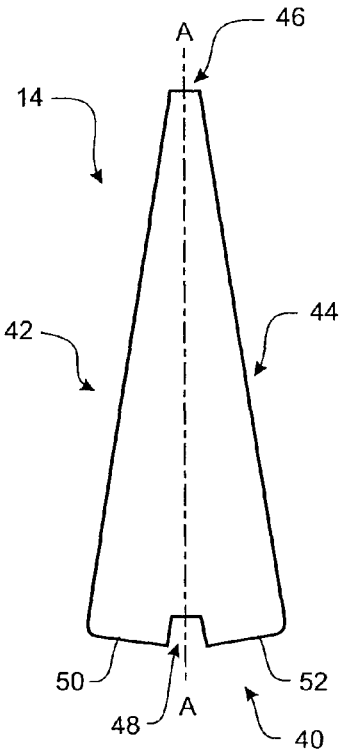
FIGS. 5A-5D show end, side elevation, plan and perspective views respectively of the shape and profile o a board of the preferred form fence.
Figure 5B:
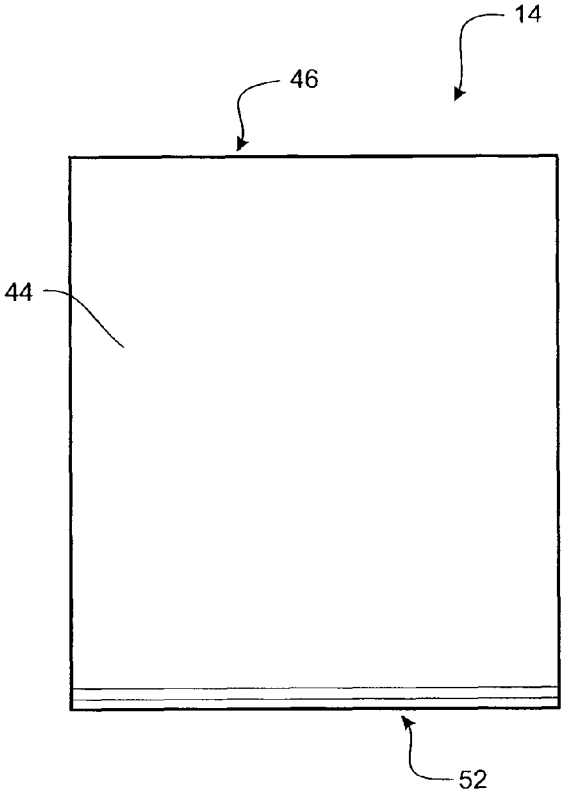
Figure 5C:
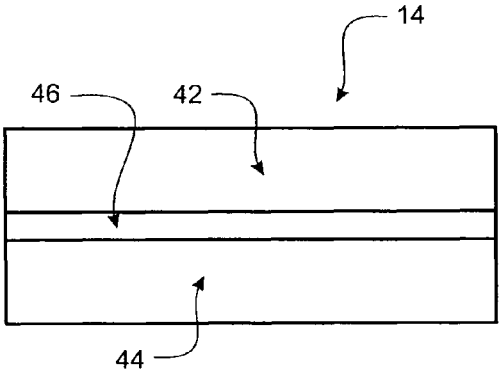
Figure 5D:
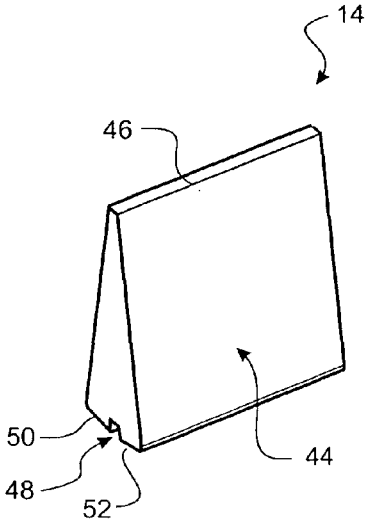

Referring to FIGS. 5A-5D, a preferred form board 14 of the fence system will be described. It will be appreciated that the length of the boards can be altered to suit requirements. The cross-sectional profile of the board is substantially triangular as shown in FIG. 5A. The triangular profile comprises a base surface 40 from which first 42 and second 44 side surfaces taper inwardly together toward an apex or top surface 46. The cross-sectional profile of the board 14 is preferably symmetrical about a central line AA extending between the base surface 40 and top apex surface 46.

In the preferred form, the base surface 40 comprises a central recess or groove 48 from which two inclined surfaces 50, 52 extend toward the first and second side surfaces 42, 44. The groove 48 or recess forms an engagement channel that is shaped and sized to receive a portion of the top apex 46 of a lower board in the stack. In particular, the top apex surface 46 of a lower board 14 is arranged to be received and retained within the channel or groove 48 of an upper board in a tongue and groove interlocking relationship as shown generally in FIG. 2 by the cut-way area 60. With this interlocking arrangement or complementary engagement of adjacent boards along their length, the stack of boards 14 in the fence have an overlapping relationship with each other and this enhances the structural integrity of the overall fence.

As mentioned, the profile of the scribes is shaped to conform to the overall profile of the stack of boards. The inclined base surfaces 50 and 52 of the boards 14 are arranged to sit on respective seat surfaces 34 of a pair of scribes located on either side of the boards and the first 42 and second 44 side surfaces of the boards are arranged to engage with respective clamping surfaces 36 of the scribes on either side of the boards. In this relationship, each pair of scribes on the fence post act to clamp the end portions of the stack of boards in place such that they are supported by the fence post.

Example Method of Installation

By way of example, a typical installation process for a fence of the invention will be described. It will be appreciated that other installation methods could be used, and the process described below is by way of example only. The framing is first constructed and the necessary fence posts installed into the ground or surface upon which the fence is to be constructed. This process may include laying concrete foundations into which the lower ends of the fence posts may be anchored, or otherwise fixing them in place. Lower cross-members 20 may also be fixed in place at their ends at or toward the bottom ends of the fence posts upon the ground surface between each pair of adjacent fence posts by nails, screws or other fixing means.

Between the or each pair of fence posts, a stack of boards 14 is then installed, and this process will be described for one stack between two adjacent fence posts 12*a*,12*b*. In the preferred form, the scribes 16*b* on one side of the fence are fixed in place by screws 22 on the opposing upright side surfaces of adjacent fence posts 12*a*,12*b* to form a series of open cavities. The boards 14 are then put in place one by one on top of each other. Each board engages with the lowermost adjacent board by the tongue and groove arrangement in an overlapping manner. In addition, the boards are temporarily supported on one side by a respective open cavity formed by the scribes 16*b* at each respective end. Once all the boards 14 of the stack have been installed, the scribes 16*a* on the other side of the stack are fixed in place by screws 22 on the fence posts 12 to close the series of cavities and thereby clamp or sandwich the stack of boards securely in place on the fence posts. Upper cross-members 21 or capping members may then be fixed at their ends at or toward the top ends of the fence posts over the stack of boards between or upon each pair of adjacent fence posts.

Example Alternative Forms and Features of the Fence

In the preferred form, like boards having a substantially identical cross-sectional profile along their length are used. However, in alternative forms of the fence, boards having different cross-sectional profiles may be used in the stack. In these constructions, the scribes can be modified to suit the non-uniform profiles of the boards in the stack.

The preferred form fence board has a substantially triangular cross-sectional profile. However, it will be appreciated that the cross-sectional profile of the boards and thereby the shape and dimension of the corresponding scribes can be altered as desired to suit aesthetic requirements. For example, the boards may alternatively have a substantially rectangular cross-sectional profile if desired. Further, the cross-sectional profile need not necessarily be symmetrical about the center of the board. The functionality of the scribes is to securely clamp and retain ends of the boards on the fence post, and therefore the shape of both the boards and scribes can be altered as desired.

It will be appreciated that other tongue and groove arrangements could be provided for interlocking the stack of boards in an overlapping relationship. The boards may be provided with various shapes of tongues, ridges or protrusions along their length that engage with one or more complementary retaining recesses or grooves of another board.

Figure 6:
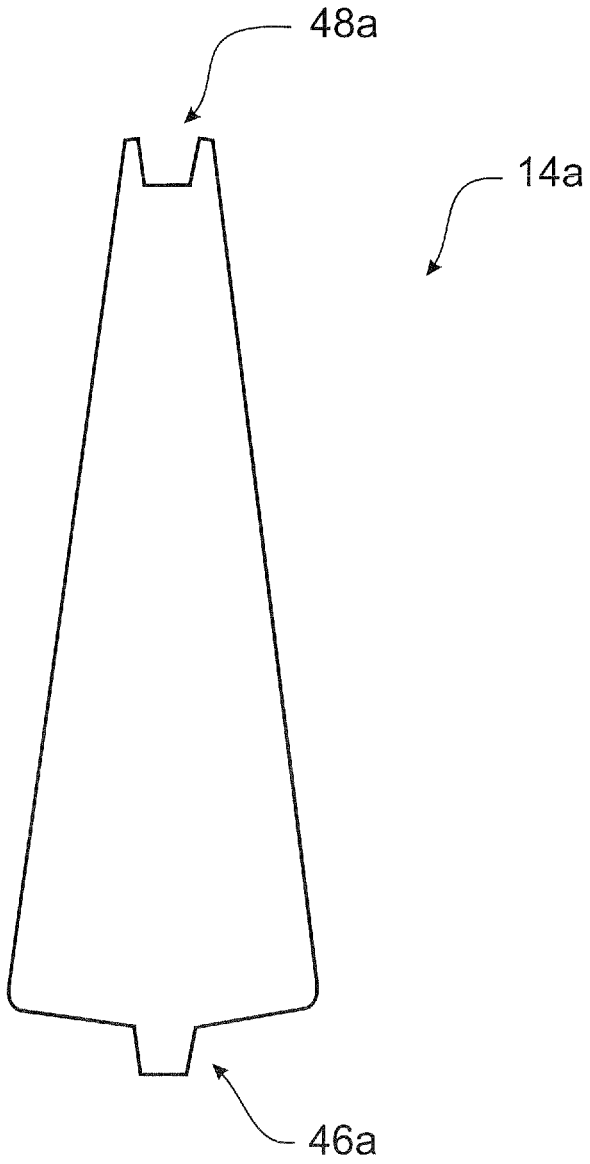
FIG. 6 shows an end view of the shape and profile of the board of FIG. 5A with an opposite tongue and groove configuration.

In an alternative embodiment, as shown in FIG. 6, the grooves 48*a* may be provided on the top surfaces of the boards 14*a* with the complementary tongues 46*a* being provided on the base surfaces of the boards. In alternative forms, the fence boards do not necessarily need to engage or overlap with each other and each board may simply abut with upper and lower adjacent boards along their length. In a further alternative form, the retaining components or formations may be arranged to provide a predetermined spacing between the top and base surfaces of adjacent boards. It will be appreciated that the spacing between the boards may be uniform up the stack or alternatively non-uniform as desired.

While the preferred form system comprises framing in which the boards are supported between two adjacent fence posts, it will be appreciated that one or both of the fence posts could alternatively be other fixed structures, such as the exterior wall or a house or building or other fixed structure. In such forms, the scribes are simply fixed to the alternative fixed structure instead of a purpose-built fence post.

As mentioned, the scribes are preferably fixed to the fence posts during construction of the fence. However, in alternative forms it may be possible for the scribes to be integrally formed with the fence posts. In a further alternative, the fence posts may be provided with integral retaining formations that form the series of cavities for receiving and retaining the ends of the boards, such that separate scribe components or portions are not required. By way of example, the integral retaining formations may be in the form of a shaped recess or series of recesses formed into the uptight side surfaces of the fence posts.

The preferred form fence typically employs solid wooden framing and fence boards. However, it will be appreciated that other materials could be used to form the framing, boards or both. For example, materials such as plastic, metal, aluminium or the like could alternatively be used for one or more of the fence components if desired. Further, the framing components and fence boards need not necessarily be solid, but may be hollow if required.

The fence posts may be timber fence posts of constant cross-section or of varying cross-section for decorative or aesthetic purposes for example, or could in other embodiments be pre-cast concrete posts or posts formed of other materials or posts constructed onsite from concrete blocks or stone for example.

Advantages and Benefits of the Fence

In some forms, the fence may provide some of the following advantages and benefits.

The boards used in the fence may be double-sided weatherboards such that the single stack of boards forms both sides of the fence. Therefore, it is not necessary to cover both sides of the framing with separate sets of fence boards.

The fence does not require the boards to be individually fixed with nails or screws to the framing due to the retaining scribes or formations and, in some forms, the interlocking and overlapping arrangement of the boards. The only fixing components required in some forms of the fence are screws or the like for securing the scribes in place on the fence posts. This saves time during fence construction. In addition, as no nails or screws extend through the individual boards, each can be pre-painted and/or pre-treated prior to installation.

The fence system is modular and scaleable in height and length to suit design requirements.

The foregoing description of the invention includes preferred forms thereof. Modifications may be made thereto without departing from the scope of the invention as defined by the accompanying claims.

The invention claimed is:

1. A fence comprising:

at least two spaced-apart substantially upright fence posts anchored into the ground or other fixed structure;

a stack of at least two boards extending between each pair of adjacent fence posts, each board having a cross-sectional profile defined by a base surface and a top surface between which two opposed first and second side surfaces extend, and wherein the cross-sectional profile is symmetrical about a center line extending from the top surface to the base surface between the side surfaces and each board extending in a substantially horizontal orientation relative to the upright fence posts and being supported at each end by a respective fence post, and each board being engaged in an overlapping relationship with adjacent upper and lower hoards of the stack via a tongue and groove interlocking arrangement; and at least one pair of spaced-apart retaining components provided on each fence post, each pair of retaining components being aligned to form a series of cavities, each cavity being shaped to receive and retain a respective end of a board of the stack to thereby support the respective end of the board at the fence post, and wherein each pair of retaining components comprises retaining components having a mirrored opposing profile to the other retaining component of the pair on inner surfaces along their length to provide a series of cavities that are symmetrical about a vertical center line extending between the pair of retaining components and each opposing profile comprising a series of engaging, formations along the length of the retaining component and wherein each engaging formation in the series of engaging formations comprises a seat surface that is engaged with a respective portion of the base surface of a board of the stack adjacent either its first or second side and a clamping portion extending upwardly from the seat surface that is engaged with a respective first or second side surface of the same board of the stack such that each pair of retaining components sandwiches respective ends of the stack of boards in that one retaining component of each pair engages with the first side surface of each board and a portion of the base surface of each board adjacent the first side and the other retaining component of the pair engages with the second side surface of each board and a portion of the base surface of each board adjacent the second side.

2. A fence according to claim 1 wherein each board comprises a tongue along the top surface and a groove along the base surface for engaging in an interlocking arrangement with adjacent boards in the stack.

3. A fence according to claim 1 wherein each board comprises a groove along its base surface and the top surface of the board is arranged as a tongue that is shaped to engage with the groove of an upper board of the stack in an interlocking arrangement.

4. A fence according to claim 3 wherein the groove of each board is centrally located in the base surface relative to the side surfaces of the board.

5. A fence according to claim 3 wherein each board has a cross-sectional profile that is substantially triangular in which the two side surfaces extend from the base surface and taper toward each other to form an apex portion at the top surface of the board.

6. A fence according to claim 5 wherein the groove of each board is centrally located in the base surface relative to the side surfaces and the apex portion of the top surface forms the tongue for engaging into the groove of an upper adjacent board of the stack in an interlocking arrangement.

7. A fence according to claim 6 wherein the seat surface of each engaging formation of the retaining components extends outwardly from the inner surface of the retaining component from a base to an outer edge and wherein the clamping portion of each engaging formation extends upwardly from the base of its associated seat surface at an angle conforming to the tapered side surfaces of the triangular boards.

8. A fence according to claim 7 wherein the base surface of each board comprises two inclined surfaces, one on each side of the groove in the base surface, with each inclined surface extending upwardly from the groove towards a respective first and second side surface, and wherein the seat surface of each engagement formation of the retaining components is angled to extend from its base to outer edge at a downward angle relative to the horizontal to conform to the respective inclined surfaces of the base surface of the associated supported hoard.

9. A fence according to claim 1 wherein each board comprises a tongue along the base surface and a groove along the top surface for engaging in an interlocking arrangement with adjacent boards in the stack.

10. A fence according to claim 1 further comprising a lower cross member fixed to extend beneath the stack of boards between each pair of adjacent upright fence posts.

11. A fence according to claim 1 further comprising an upper cross-member that is fixed to extend above the stack of boards in between or upon each pair of adjacent upright fence posts.

12. A method of constructing a fence according to claim 1 comprising the steps of:

(a) fixing at least two spaced-apart fence posts into the ground or surface such that they extend in a substantially upright orientation;

(b) fixing at least one of the retaining components of each pair of retaining components to one side of a surface of each fence post to provide a series of open cavities that are shaped to receive and support a respective end of a board;

(c) stacking the boards upon each other between each pair of adjacent fence posts to a desired height such that each board is supported at its ends by respective open cavities of the fixed retaining components; and (d) fixing the opposing retaining component of each pair to the opposite side of the respective surfaces of the fence posts to close the series of cavities and thereby secure the stack of boards in place between each adjacent pair of fence posts.

13. A method of constructing a fence according to claim 12 further comprising the step of fixing a lower cross-member between each pair of adjacent fence posts at or toward the bottom end of the fence posts before step (a).

14. A method of constructing a fence according to claim 12 further comprising the step of fixing an upper cross-member between or upon each pair of adjacent fence posts at or toward the top end of the fence posts after step (d).

15. A modular fence system comprising one or more adjacent fence blocks that collectively form a fence, each fence block comprising:

two spaced apart pairs of substantially upright retaining components;

a stack of at least two boards extending between the two pairs of retaining components, each board having a cross-sectional profile defined by a base surface and a top surface between which two opposed first and second side surfaces extend, and wherein the cross-sectional profile is symmetrical about a center line extending from the top surface to the base surface between the side surfaces and each board extending in a substantially horizontal orientation relative to the upright retaining components and being supported at each end by a respective pair of spaced-apart retaining components, and each board being engaged in an overlapping relationship with adjacent upper and lower boards of the stack via a tongue and groove interlocking arrangement; and wherein each pair of retaining components is aligned to form a series of cavities, each cavity being shaped to receive and retain a respective end of a board of the stack to thereby support the respective end of the board, and wherein each pair of retaining components comprises retaining components having a mirrored opposing profile to the other retaining component of the pair on inner surfaces along their length to provide a series of cavities that are symmetrical about a vertical center line extending between the pair of retaining components and each opposing profile comprising a series of engaging formations along the length of the retaining component and wherein each engaging formation in the series of engaging formations comprises a seat surface that is engaged with a respective portion of the base surface of a board of the stack adjacent either its first or second side and a clamping portion extending upwardly from the seat surface that is engaged with a respective first or second side surface of the same board of the stack such that each pair of retaining components sandwiches respective ends of the stack of boards in that one retaining component of each pair engages with the first side surface of each board and a portion of the base surface of each board adjacent the first side and the other retaining component of the pair engages with the second side surface of each board and a portion of the base surface of each board adjacent the second side.

16. A modular fence system according to claim 15 wherein each board comprises a tongue along the top surface and a groove along the base surface for engaging in an interlocking arrangement with adjacent boards in the stack.

17. A modular fence system according to claim 15 wherein each board comprises a groove along the base surface and the top surface of the board is arranged as a tongue that is shaped to engage with the groove of an upper board of the stack in an interlocking arrangement.

18. A modular fence system according to claim 17 wherein each board has a cross-sectional profile that is substantially triangular in which the two side surfaces extend from the base surface and taper toward each other to form an apex portion at the top surface of the board.

19. A modular fence system according to claim 18 wherein the groove of each board is centrally located in the base surface relative to the side surfaces and the apex portion of the top surface forms the tongue for engaging into the groove of an adjacent upper board of the stack in an interlocking arrangement.

20. A modular fence system according to claim 19 wherein the seat surface of each engaging formation of the retaining components extends outwardly from the inner surface of the retaining component from a base to an outer edge and wherein the clamping portion of each engaging formation extends upwardly from the base of its associated seat surface at an angle conforming to the tapered side surfaces of the triangular boards.

21. A modular fence system according to claim 20 wherein the base surface of each board comprises two inclined surfaces, one on each side of the groove in the base surface, with each inclined surface extending upwardly from the groove towards a respective first and second side surface, and wherein the seat surface of each engagement formation of the retaining components is angled to extend from its base to outer edge at a downward angle relative to the horizontal to conform to the respective inclined surfaces of the base surface of the associated supported board.

22. A modular fence system according to claim 15 wherein each board comprises a tongue along its base surface and a groove along its top surface for engaging in an interlocking arrangement with adjacent boards in the stack.

* * * * *